US008839800B2

(12) United States Patent
Miyauchi et al.

(10) Patent No.: US 8,839,800 B2
(45) Date of Patent: Sep. 23, 2014

(54) TOBACCO PRODUCT

(71) Applicant: Japan Tobacco Inc., Tokyo (JP)

(72) Inventors: Masato Miyauchi, Tokyo (JP); Tetsuya Yoshimura, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 7 days.

(21) Appl. No.: 13/747,160

(22) Filed: Jan. 22, 2013

(65) Prior Publication Data

US 2013/0133673 A1 May 30, 2013

Related U.S. Application Data

(63) Continuation of application No. PCT/JP2010/062373, filed on Jul. 22, 2010.

(51) Int. Cl.
*A24B 13/00* (2006.01)

(52) U.S. Cl.
USPC ..... 131/352; 131/365

(58) Field of Classification Search
USPC ..... 131/365
See application file for complete search history.

(56) References Cited

U.S. PATENT DOCUMENTS

| | | | | |
|---|---|---|---|---|
| 4,480,644 | A * | 11/1984 | Luke | 131/68 |
| 5,143,099 | A | 9/1992 | Le Gars et al. | |
| 6,705,325 | B1 | 3/2004 | Hicks et al. | |
| 2007/0051383 | A1 * | 3/2007 | Woods | 131/365 |
| 2007/0137667 | A1 * | 6/2007 | Zhuang et al. | 131/360 |
| 2010/0218779 | A1 * | 9/2010 | Zhuang et al. | 131/274 |

FOREIGN PATENT DOCUMENTS

| | | | |
|---|---|---|---|
| EP | 0 402 059 | A2 | 12/1990 |
| JP | 3-43068 | A | 2/1991 |
| JP | 2660876 | B2 | 10/1997 |
| JP | 2006-516188 | A | 6/2006 |
| JP | 4024249 | B2 | 12/2007 |
| TW | 201013020 | A1 | 4/2010 |
| WO | WO 2004/052128 | A2 | 6/2004 |

OTHER PUBLICATIONS

International Search Report, dated Dec. 28, 2010, issued in PCT/JP2010/062373.

Written Opinion of the International Searching Authority, dated Dec. 28, 2010, issued in PCT/JP2010/062373.

* cited by examiner

*Primary Examiner* — Richard Crispino

*Assistant Examiner* — Eric Yaary

(74) *Attorney, Agent, or Firm* — Birch, Stewart, Kolasch & Birch, LLP

(57) ABSTRACT

A tobacco product produced by wrapping cut tobacco with a pouch or a cigarette paper, wherein the pouch or the cigarette paper has an inner layer and an outer layer, and a paper of the outer layer has an air permeability higher than that of a paper of the inner layer.

6 Claims, 5 Drawing Sheets

TOBACCO PRODUCT

CROSS REFERENCE TO RELATED APPLICATIONS

This application is a Continuation Application of PCT Application No. PCT/JP2010/062373, filed Jul. 22, 2010, the entire contents of which are incorporated herein by reference.

BACKGROUND OF THE INVENTION

1. Field of the Invention

The present invention relates to a tobacco product produced by wrapping cut tobacco with a pouch or a cigarette paper.

2. Description of the Related Art

SNUS may be spotted on the pouch after it is produced and before it is delivered to a user. Occurrence of spots on the pouch of SNUS causes a problem such that a user has an impression of reduced quality of the product. Accordingly, it is desired to suppress spots as much as possible. There is the same problem of spots on cigarette paper. The spots occur where a component of cut tobacco, wrapped with a pouch or a cigarette paper, permeates the pouch or the cigarette paper.

Japanese Patent No. 2,660,876 and U.S. Pat. No. 5,143,099 disclose use of double cigarette papers, in which a cigarette paper provided with pores and having a low basis weight and a high air-permeability is used as an inside cigarette paper in order to reduce spots on the cigarette. The documents also disclose applying a sizing agent such as alkali ketene dimer to the paper in order to control surface wettability.

Permeation of a spotting component into the pouch or the cigarette paper is a phenomenon caused by capillary force. The capillary force is reduced as the pore size of the paper is larger, and a permeation distance becomes longer as the pore size of the paper is smaller. In the case where the pore size of the inside cigarette paper is larger than that of the outside cigarette paper as in Japanese Patent No. 2,660,876 and U.S. Pat. No. 5,143,099, when the spotting component penetrates the inside cigarette paper, the spotting component also penetrates the outside cigarette paper. Therefore, the techniques of Japanese Patent No. 2,660,876 and U.S. Pat. No. 5,143,099 intend to reduce spots by simply providing the inside cigarette paper rather than by the effect of the double cigarette papers.

Japanese Patent No. 4,024,249 relates to a smoking product the side stream smoke of which is flavored and discloses that an encapsulated flavor is retained between the inner and outer layers of double cigarette papers, in which the outside cigarette paper has an air permeability of 200 CU or more and the inside cigarette paper has an air permeability lower than that. In Japanese Patent No. 4,024,249, the flavor component is evaporated from the encapsulated flavor provided between the layers of double cigarette papers to facilitate diffusion through the cigarette paper.

However, since Japanese Patent No. 4,024,249 does not take permeation of liquid and spotting into consideration, influence of the air permeability of each of the inside cigarette paper and the outside cigarette paper as well as double cigarette papers on permeation of liquid and spotting are unclear.

BRIEF SUMMARY OF THE INVENTION

An object of the present invention is to prevent the pouch or the cigarette paper from being spotted with liquid in a tobacco product produced by wrapping cut tobacco with a pouch or a cigarette paper.

According to the present invention, there is provided a tobacco product produced by wrapping cut tobacco with a pouch or a cigarette paper, wherein the pouch or the cigarette paper has an inner layer and an outer layer, and a paper of the outer layer has an air permeability higher than that of a paper of the inner layer.

DETAILED DESCRIPTION OF THE INVENTION

According to the present invention, cut tobacco are wrapped with a two-layered pouch or cigarette paper, including an inner layer and an outer layer, and the air permeability of the outer layer is made higher than that of the inner layer so that the pouch or the cigarette paper is prevented from being spotted with liquid.

Figure 1:
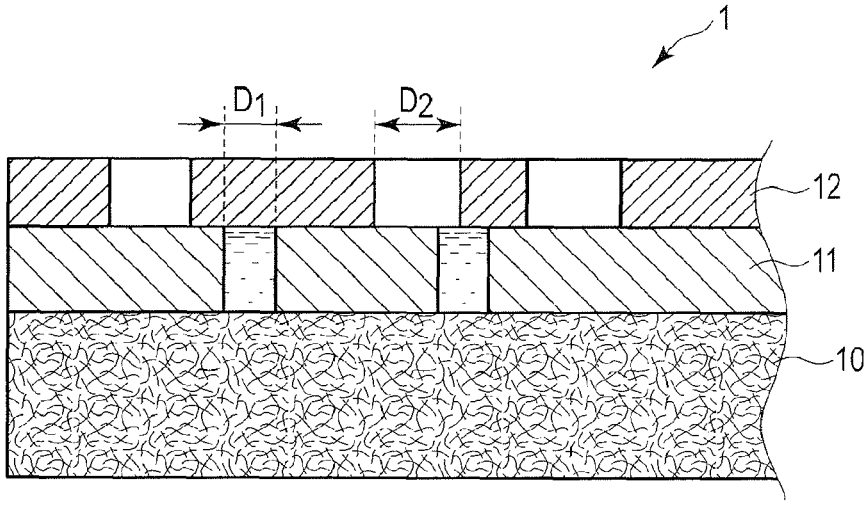
FIG. 1 is a cross-sectional view of a tobacco product according to the present invention.

FIG. 1 shows a cross-sectional view of a tobacco product according to the present invention. As shown in FIG. 1, a tobacco product 1 according to the present invention is produced by wrapping cut tobacco 10 with a two-layered pouch or cigarette paper including an inner layer 11 and an outer layer 12. The air permeability of the outer layer 12 is higher than that of the inner layer 11. This means that a pore size $D_2$ of the outer layer 12 is larger than a pore size $D_1$ of the inner layer 11. Hereinafter, a reason why the configuration of the present invention allows the pouch or the cigarette paper to be prevented from being spotted with liquid will be explained. As described above, the reason can be explained based on the fact that permeation of liquid into the pouch or the cigarette paper is a phenomenon caused by capillary force.

Firstly, if pores become completely wet with liquid, permeation of liquid is caused by capillary force. However, if the pores do not become wet with liquid, the permeation of liquid can be prevented. As depicted in FIG. 1, if the pore size $D_2$ of the outer layer 12 is larger than the pore size $D_1$ of the inner layer 11, the possibility that the pores will become wet with liquid becomes low. Thus, the permeation of liquid, and thus occurrence of spots can be prevented.

Secondly, since the smaller the pore size of the paper is the larger the capillary force becomes, the permeation distance becomes longer. In the case of the combination of the inner layer having a small pore size and the outer layer having a large pore size, since the inner layer has a water retention function, the liquid starts to penetrate the outer layer having a large pore size when the liquid is sufficiently filled in the pores of the inner layer and exceeds the capillary force in the pores of the inner layer. On the contrary, in the case of the combination of the inner layer having a large pore size and the outer layer having a small pore size, since the capillary force in large pores in the inner layer is small, the liquid easily exceeds the small capillary force, and thus, the liquid easily penetrates the outer layer from the inner layer. As described above, in the case of the combination of the inner layer having a small pore size and the outer layer having a large pore size, the penetration of the liquid becomes difficult due to the water retention effect of the inner layer, and thus, spots of liquid can be prevented.

Theoretical considerations related to the fact that the larger the pore size of paper is the smaller capillary force becomes, namely lower the liquid sucking height becomes is described in, for example, the reference: Nakanishi et al., Journal of Chemical Engineering of Japan, 14(6), pp. 794-802, 1988.

In the present invention, the spots of liquid can be more effectively prevented by inserting a spacer between the inner and outer layers to form a gap between the both layers or applying a sizing agent to increase a contact angle.

In the present invention, the prevention of spots due to two-layering of papers depends on the pore size. Thus, the type of paper of the inner layer and the outer layer may be either a non-woven fabric or a machine-made Japanese paper, and the type is not particularly limited.

The technique of preventing spots on the pouch or cigarette paper in the present invention is made by utilizing the capillary force phenomenon. Thus, the technique is realized only when the pouch or cigarette paper having a two-layered structure is dry. For example, there is no need to take into consideration a phenomenon that the component in the pouch is eluted when a SNUS is put into a user's mouth, as a point of use of the SNUS, and the whole pouch having a two-layered structure gets wet.

Here, the spots are caused by the penetration of liquid into the paper in a cross sectional direction. It is known that the permeation of liquid is caused by the pore structure of the paper (M. Miyauchi and Y. Nakanishi, Drying Technology, 24, 31-36, 2006). On the other hand, the air permeability of the paper also depends on the pore structure of the paper.

The time required for liquid to penetrate the cross section of a sheet of paper was calculated using a device for checking the degree of liquid penetration described in Jpn. Pat. Appln. KOKAI Publication No. 2007-255891 or the above reference (Dying Technology, 24, 31-36, 2006). On the other hand, the air permeability was measured by the method described in CORESTA Recommended Method No. 40. As for the air permeability, a flow rate of the gas, which passes through an area of 1 $cm^3$ when the differential pressure of both sides of the paper is 1 kPa, is represented by a unit of $cm^3$/min. 1 $cm^3$/min is referred to 1 CU (CORESTA UNIT).

Figure 2:
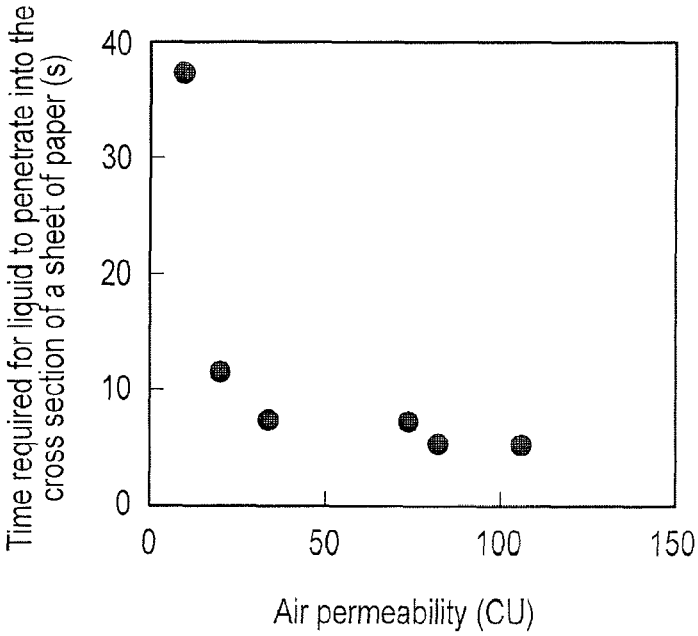
FIG. 2 is a graph showing a relationship between the air permeability of the paper and the time required for liquid to penetrate the cross section of a sheet of paper.

FIG. 2 shows a relationship between the air permeability of the paper and the time required for liquid to penetrate the cross section of a sheet of paper. As shown in FIG. 2, if the air permeability of the paper becomes higher, the time required for liquid to penetrate the cross section of the sheet of paper becomes shorter. Thus, the air permeability has a correlation with the time required for liquid to penetrate the cross section of a sheet of paper. According to the theoretical formula described in the reference, it is found that the time required for liquid to penetrate the cross section of a sheet of paper depends on the porosity, i.e., the pore size.

In the present invention, as a relationship equivalent to making the pore size of the outer layer to be higher than that of the inner layer, it is specified that the air permeability of the outer layer is made higher than that of the inner layer.

In the present invention, in order to control the air permeability of the paper, the specification of the paper or the production process may be adjusted or pores may be produced in paper. Known examples of a method of adjusting the distribution of voids of 10 μm or less in the paper layer of cigarette paper includes a method of adjusting the additive amount of calcium carbonate, a method of adjusting the degree of beating of pulp, and a method of adjusting the dehydration rate in a paper-making process. In order to produce pores in the paper, a method of mechanically or electrically punching pores in a sheet of cigarette paper by a usual procedure may be used. Specifically, usable examples thereof include a mechanical method of press-punching pores in a sheet of cigarette paper with a needle-shaped die, an electrical method based on corona discharge, and a method of pulse-irradiating a sheet of cigarette paper with a continuous beam output from a laser oscillator by a rotating chopper while continuously moving the cigarette paper.

EXAMPLES

In order to easily and rapidly determine the effect of reducing spots on the pouch having a two-layered structure, cut tobacco with a high moisture content and much free water were prepared to produce a SNUS. The resultant product was subjected to the tests.

(1) 20 g of the cut tobacco were weighed and 20 g of water was added thereto with a glass sprayer. The obtained cut tobacco was dried at 100° C. for 1 hour. When the reduced amount was deemed to be water, the calculated moisture content in the cut tobacco was 53% wet basis.

On the other hand, papers having air permeability from 40000 CU (more than the measurement limit of PPM 300, manufactured by Filtrona) to 9 CU were used. The physical properties of each paper are shown in Table 1.

According to the method described in the reference (Dying Technology, 24, 31-36, 2006), even in the case of the paper J with the slowest permeation rate, the time required for liquid to penetrate the cross section of a sheet of paper was 38 seconds.

TABLE 1

| Sample | Air permeability (CU) | Basis weight ($g/m^2$) |
|---|---|---|
| A | Unmeasurable 40000 or more | 30 |
| B | 29400 | 21 |
| C | 21600 | 26.5 |
| D | 10900 | 24 |
| E | 108 | 27 |
| F | 84 | 28 |
| G | 21 | 24 |
| H | 20 | 15 |
| I | 10 | 63 |
| J | 9 | 36 |

Each paper described in Table 1 was cut into a rectangle (about 25 mm×about 30 mm). The center of the paper was folded and both sides thereof were fixed to form a pocket (about 18 mm in width×about 12 mm in height). 280±10 mg of the cut tobacco with high moisture content was put into the pocket. The remaining sides were fixed to produce a sample. Each paper was fixed with a stapler taking into consideration quickness. The combinations of each paper are shown in Table 2.

TABLE 2

| | Outer layer | Inner layer |
|---|---|---|
| Example 1 (Outer layer > Inner layer) | paper - A | paper - B, C, D, E, F, G, H, I, J |
| Comparative Example 1 (Outer layer ≤ Inner layer) | paper - A, B, C, D, E, F, G, H, I, J | paper - A |
| Example 2 (Outer layer > Inner layer) | paper - D | paper - E, F, G, H, J |
| Comparative Example 2 (Outer layer ≤ Inner layer) | paper - D, E, F, G, H, J | paper - D |
| Example 3 (Outer layer > Inner layer) | paper - E | paper - G, H |
| Comparative Example 3 (Outer layer ≤ Inner layer) | paper - G, H | paper - E |
| Example 4 (Outer layer > Inner layer) | paper - G, H | paper - J |
| Comparative Example 4 (Outer layer ≤ Inner layer) | paper - J | paper - G, H |

Figure 3:
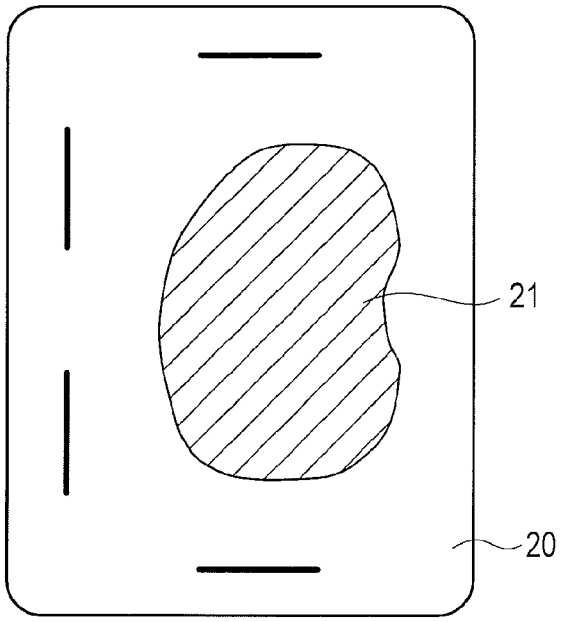
FIG. 3 is a view schematically showing a state of occurrence of a spot on the surface of an outer layer of a pouch.

Subsequently, the state of occurrence of spot was evaluated as follows. A glass plate (ϕ 42 mm, 15.75 g) was placed on each sample. A load was applied from the top of the plate for 3 minutes using a 200 g weight to directly bring the paper of the inner layer into contact with the free water present in cut tobacco. After removing the weight, the sample was placed in a sealed bottle and stored. After one day, the sample was taken out from the sealed bottle and the surface of the outer layer of the sample was photographed. FIG. 3 schematically shows a spotted state on the surface of an outer layer of a pouch. In the drawing, a spot 21 on the surface of the outer layer of a pouch 20 is depicted in hatch lines. Subsequently, the obtained photographic image was subjected to image analysis using WinROOF (ver. 6.3.1, MITANI CORPORATION) and the spotted area ratio was determined. The image analysis was performed as follows. First, binarization processing was performed by RGB color extraction to cut out a spotted region. Subsequently, a ratio of the area of the binarized region to the total area of the sample was calculated as the spotted area ratio.

Figure 4:
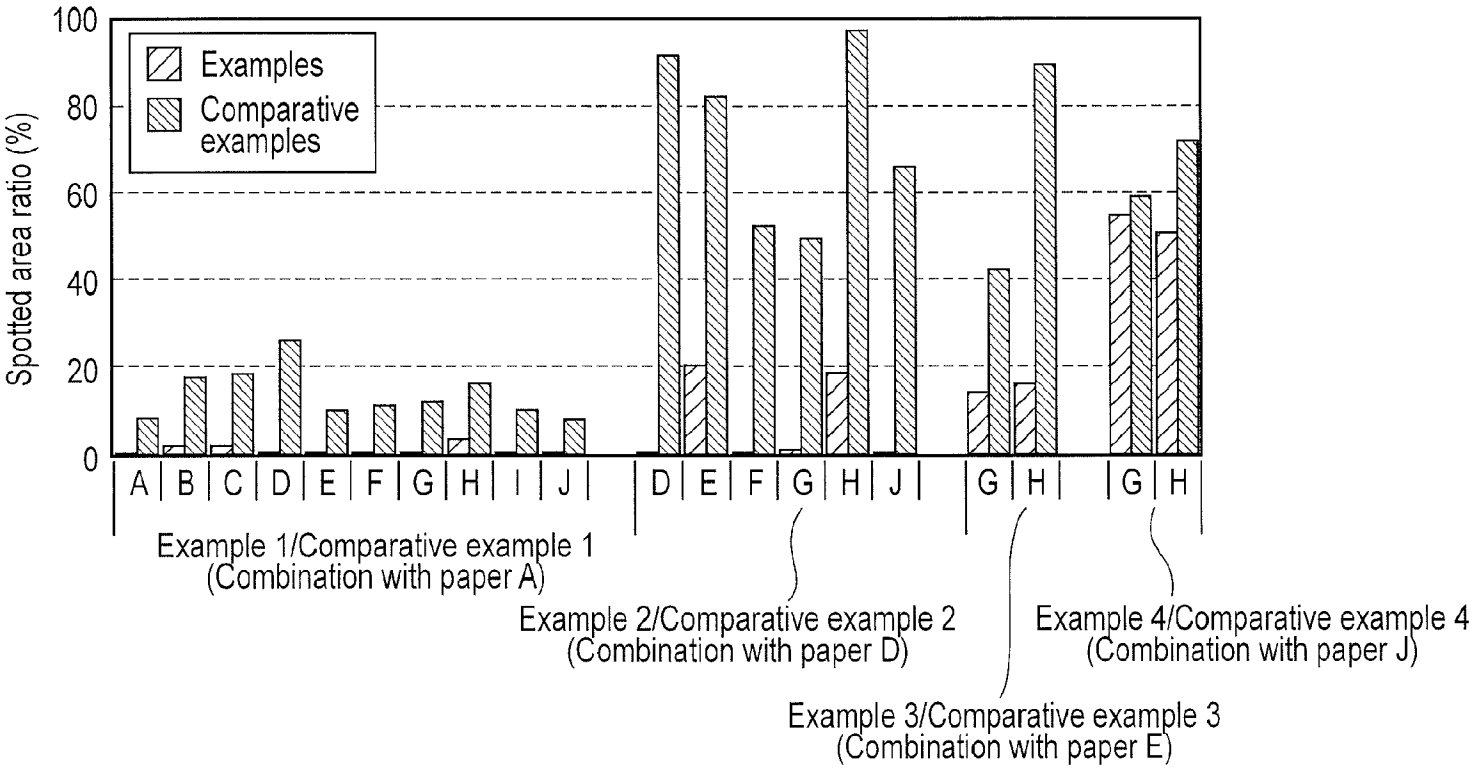
FIG. 4 is a graph showing spotted area ratios in samples of Examples 1 to 4 and Comparative examples 1 to 4.

FIG. 4 shows spotted area ratios of samples with each combination in Examples 1 to 4 and Comparative examples 1 to 4. From FIG. 4, it is found that the sample using the paper having air permeability higher than that of the inner layer as the outer layer is less spotted as compared with the sample using the paper having air permeability lower than that of the inner layer as the outer layer or the sample using the paper having air permeability equal to that of the inner layer as the outer layer. As was expected, a large difference between the papers H and I having a different basis weight of cigarette paper and the other samples was not observed. It was found that the basis weight of the paper has less relevance.

As for the combination of the inner and outer layers of the papers having a two-layered structure, the followings were found. When a non-woven fabric like the paper A is used as the outer layer, the paper having air permeability of 30000 CU or less is preferably disposed as the inner layer. When the paper having air permeability of 10000 CU or less is used as the outer layer, the paper having air permeability of 100 CU or less is preferably used as the inner layer. On the other hand, when the paper J having air permeability of 9 CU is used, the pore size becomes small and the permeation distance becomes long. Accordingly, like the examples, under the conditions where free water in cut tobacco with high moisture content can move freely due to load application, the free water sufficiently permeates paper having a small pore size, and the water retention effect of the paper J is reduced. Therefore, if there is no sufficient deviation in air permeability between the inner and outer layers, the effect of reducing spots due to two-layering of papers according to the present invention is very low.

The paper having high air permeability used for the experiments has high transparency. Thus, in order to improve the appearance quality by reduction in spots, the paper having high air permeability is preferably opacified by the addition of a loading material.

(2) As a pouch for SNUS, the paper having air permeability of 40000 CU or more (more than the measurement limit of PPM 300, manufactured by Filtrona) like the non-woven fabric is generally used in many cases. Then, the paper having such air permeability level was subjected to tests.

However, if the air permeability is too high, it is impossible to measure a relationship between the pressure and the flow rate for calculating the air permeability with PPM 300, manufactured by Filtrona. In such a case, an alternative measurement was performed as follows and an indicator of air permeability was calculated. The air permeability was measured according to the measurement manual except that two sheets of paper were laid. Even if the two sheets of paper were thus laid, the flow rate exceeded 80 L/min, which is the measurement limit of the measurement device. Then, an indicator of alternative air permeability was calculated from the relationship of the pressure and the flow rate which were obtained at a flow rate of 80 L/min or less. It was found that the relationship between the pressure and the flow rate had a sufficient linearity and the level of the air permeability of the paper sample subjected to the test could be properly determined when calculating the indicator of alternative air permeability. Then, an alternative indicator value for each of the papers A to D was measured. The physical properties of each paper are shown in Table 3.

TABLE 3

| Sample | Air permeability (CU) | Alternative Air permeability | Basis weight ($g/m^2$) |
|---|---|---|---|
| K | Unmeasurable | 51900 | 23 |
| L | 40000 or | 47100 | 23 |
| M | more | 46400 | 31 |
| N | | 45200 | 30 |
| O | | 40300 | 27 |
| P | | 39700 | 28 |
| A | | 47600 | 30 |
| B | 29400 | 18100 | 21 |
| C | 21600 | 13000 | 26.5 |
| D | 10900 | 5700 | 24 |

Samples were produced using the papers shown in Table 3 in the same manner as described above. The combinations of each paper are shown in Table 4.

TABLE 4

| | Outer layer Inner | layer |
|---|---|---|
| Example 5 (Outer layer > Inner layer) | paper - K, A, P | paper - B |
| Comparative Example 5 (Outer layer ≤ Inner layer) | paper - B | paper - K, A, P |
| Example 6 (Outer layer > Inner layer) | paper - K, A, P | paper - C |
| Comparative Example 6 (Outer layer ≤ Inner layer) | paper - C | paper - K, A, P |
| Example 7 (Outer layer > Inner layer) | paper - K | paper - P |
| Comparative Example 7 (Outer layer ≤ Inner layer) | paper - P | paper - K |

TABLE 4-continued

| | Outer layer Inner | layer |
|---|---|---|
| Example 8 (Outer layer > Inner layer) | paper - M | paper - P |
| Comparative Example 8 (Outer layer ≤ Inner layer) | paper - P | paper - M |
| Example 9 (Outer layer > Inner layer) | paper - K, A, L, M, N, O, P<br>paper - K, A, L, M, N, O, P | paper - B<br>paper - C |

Figure 5:
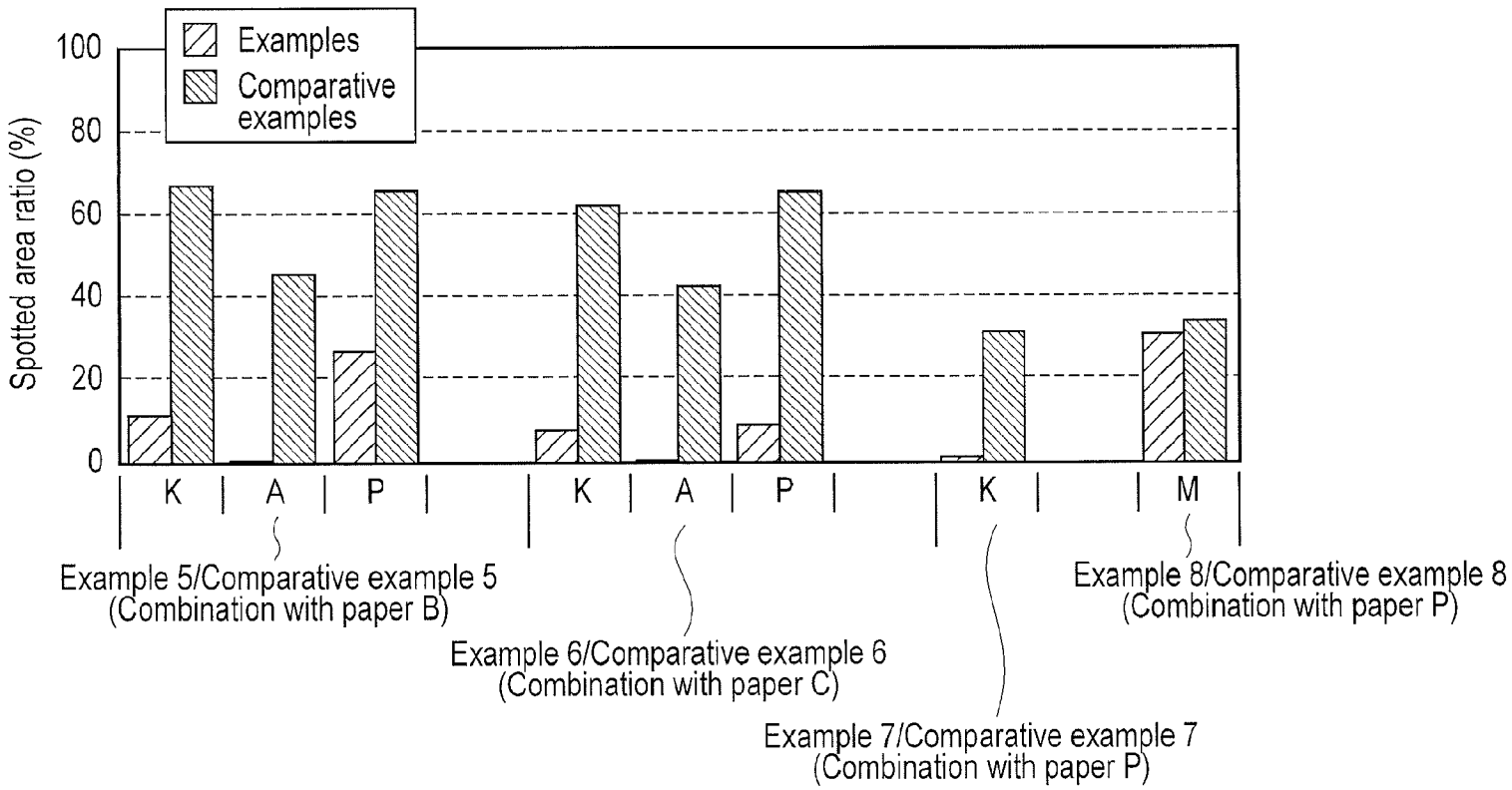
FIG. 5 is a graph showing spotted area ratios in samples of Examples 5 to 8 and Comparative examples 5 to 8.
Figure 6:
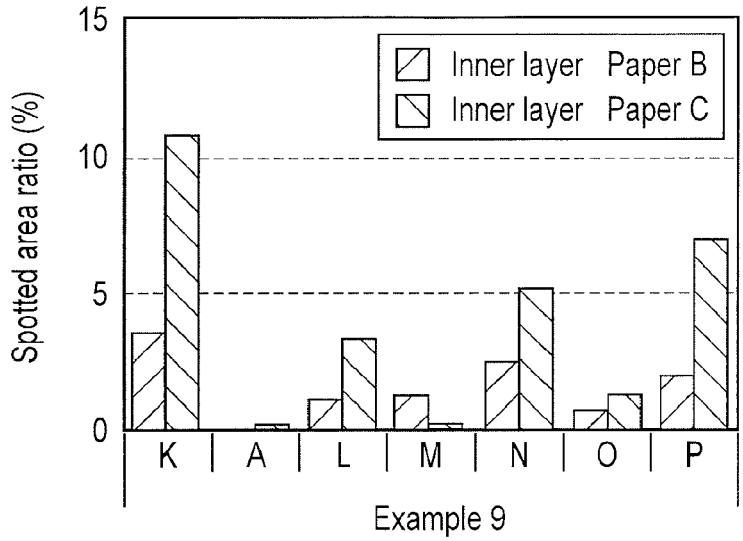
FIG. 6 is a graph showing spotted area ratios in a sample of Example 9.

Subsequently, similarly to the above procedures, the paper of the inner layer was directly brought into contact with the free water present in cut tobacco, and then the surface of the outer layer of the sample was photographed, and the spotted area ratio was determined by image analysis. FIG. 5 shows spotted area ratios of samples with each combination of Examples 5 to 8 and Comparative examples 5 to 8. From FIG. 5, even when the paper of non-woven fabric having high air permeability was used as the outer layer, the sample using as the outer layer the paper having air permeability higher than that of the inner layer was less spotted as compared with the sample not the case. FIG. 6 shows spotted area ratios obtained in samples with each combination in Example 9, i.e., samples with a combination of the papers having air permeability of 20000 CU or more. It is clear that the spotted area ratios shown in FIG. 6 are sufficiently low as compared with those in the comparative examples shown in FIGS. 4 and 5. Therefore, in the combination of the papers having air permeability of 20000 CU or more, it is found that the samples using the paper having air permeability higher than that of the inner layer as the outer layer were less spotted.

Each combination in Examples 5 to 9 and Comparative examples 5 to 9 was photographed and the photographs was observed. As a result, even when the paper of non-woven fabric having high air permeability was used as the outer layer, the sample using as the outer layer the paper having air permeability higher than that of the inner layer was less spotted as compared with the sample not the case.

As for the combination of the inner and outer layers of the papers having a two-layered structure, the followings were found. When a non-woven fabric having air permeability of 30000 CU or more is used as the outer layer, the paper having air permeability of 30000 CU or less, further 20000 CU or less, is preferably disposed as the inner layer.

Further, the followings were found by evaluation from the comparison of Examples 7 and 8 with Comparative examples 7 and 8 using the indicator of alternative air permeability. That is, it was found that when the non-woven fabrics were used as the outer layer and the inner layer like Example 8 and Comparative example 8 and there was no sufficient difference in alternative air permeability between the both layers, the effect of reducing spots was low under the conditions where free water in cut tobacco with high moisture content could move due to load application. On the other hand, it was found that even when the non-woven fabrics were used as the outer layer and the inner layer, if the difference in alternative air permeability between the both layers was 10000 CU or more like Example 7 and Comparative example 7, a sufficient effect of reducing spots could be obtained.

Figure 7:
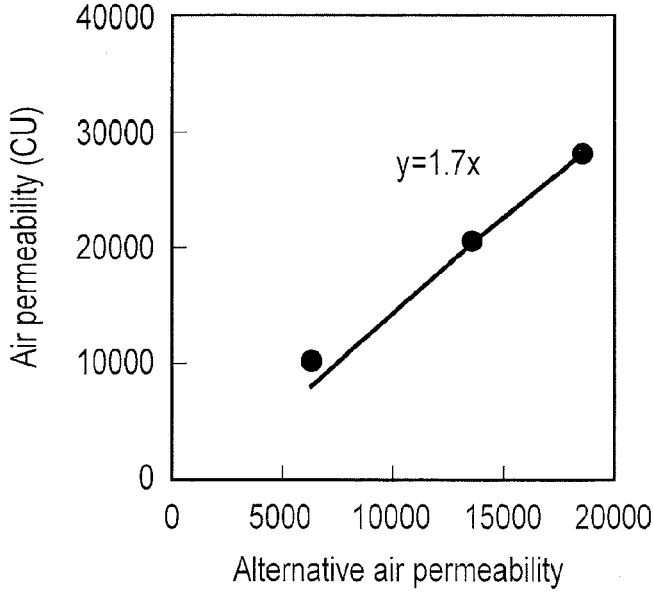
FIG. 7 is a graph showing a relationship between the air permeability and the alternative air permeability for papers B, C, and D.

The deviation in alternative air permeability between Example 7 and Comparative example 7 is 12200 CU, and the deviation in alternative air permeability between Example 8 and Comparative example 8 is 6700 CU. Here, as for the papers B, C, and D, a relationship between the air permeability and the alternative air permeability is shown in FIG. 7. If the relationship obtained from the drawing is used, the deviation in air permeability between Example 7 and Comparative example 7 corresponds to 21000 CU, and the deviation in air permeability between Example 8 and Comparative example 8 corresponds to 11000 CU. Therefore, it was found that, even when the non-woven fabrics were used as the outer layer and the inner layer, if the difference in air permeability between the both layers was 20000 CU or more, a sufficient effect of reducing spots could be obtained.

What is claimed is:

1. A tobacco product produced by wrapping cut tobacco with a pouch for SNUS, wherein the pouch has an inner layer and an outer layer, and a paper of the outer layer has an air permeability higher than that of a paper of the inner layer, wherein the paper of the outer layer and the paper of the inner layer are non-woven fabrics and a difference in air permeability between the paper of the outer layer and the paper of the inner layer is 20000 CU or more.

2. The tobacco product according to claim 1, wherein the paper of the outer layer is a non-woven fabric and the paper of the inner layer has an air permeability of 30000 CU or less.

3. The tobacco product according to claim 1, wherein the paper of the inner layer has an air permeability of 9 CU or more.

4. A tobacco product produced by wrapping cut tobacco with a pouch for SNUS, wherein the pouch has an inner layer and an outer layer, and a paper of the outer layer has an air permeability higher relative to the air permeability of a paper of the inner layer, said inner layer having a small pore size relative to a pore size of the outer layer, and said inner layer having a water retention function wherein when liquid starts to penetrate the outer layer having the large pore size when the liquid is sufficiently filled in the pores of the inner layer and exceeds the capillary force in the pores of the inner layer the penetration of the liquid is reduced due to the water retention effect of the inner layer for preventing spots of liquid, wherein the paper of the outer layer and the paper of the inner layer are non-woven fabrics and a difference in air permeability between the paper of the outer layer and the paper of the inner layer is 20000 CU or more.

5. The tobacco product according to claim 4, wherein the paper of the outer layer is a non-woven fabric and the paper of the inner layer has an air permeability of 30000 CU or less.

6. The tobacco product according to claim 4, wherein the paper of the inner layer has an air permeability of 9 CU or more.

* * * * *